US006444625B1

(12) United States Patent
Muir et al.

(10) Patent No.: US 6,444,625 B1
(45) Date of Patent: Sep. 3, 2002

(54) HIGH VISCOSITY OVERBASED SULFONATE DETERGENT AND MARINE CYLINDER OILS CONTAINING SAME

(75) Inventors: Ronald J. Muir, West Hill; Theo I. Eliades, Scarborough, both of (CA); Leonard Matthews, New Milford, CT (US)

(73) Assignee: Crompton Corporation, Middlebury, CT (US)

( * ) Notice: Subject to any disclaimer, the term of this patent is extended or adjusted under 35 U.S.C. 154(b) by 0 days.

(21) Appl. No.: 09/656,049

(22) Filed: Sep. 6, 2000

Related U.S. Application Data

(62) Division of application No. 09/041,494, filed on Mar. 12, 1998.

(51) Int. Cl.[7] ..... C01M 159/02; C01M 159/22; C01M 159/24

(52) U.S. Cl. ..... 508/391; 508/398

(58) Field of Search ..... 508/391, 398

(56) References Cited

U.S. PATENT DOCUMENTS

| | | | | | |
|---|---|---|---|---|---|
| 3,480,550 | A | * | 11/1969 | Henderson et al. | 508/391 |
| 3,537,996 | A | | 11/1970 | Hoist et al. | |
| 3,779,920 | A | * | 12/1973 | Devries | |
| 3,878,115 | A | * | 4/1975 | Souillard et al. | 508/391 |
| 4,086,170 | A | | 4/1978 | De Clippeleir et al. | |
| 4,104,180 | A | * | 8/1978 | Burnop | 508/391 |
| 4,131,551 | A | * | 12/1978 | Thompson et al. | |
| 4,283,294 | A | * | 8/1981 | Clarke | 508/391 |
| 4,288,336 | A | * | 9/1981 | Stanton | 508/391 |
| 4,328,111 | A | * | 5/1982 | Watson et al. | 508/391 |
| 4,358,387 | A | * | 11/1982 | Zoleski et al. | 508/391 |
| 4,375,417 | A | * | 3/1983 | Zoleski et al. | 508/391 |
| 4,387,033 | A | * | 6/1983 | Lenack et al. | 508/391 |
| 4,420,407 | A | * | 12/1983 | Sung et al. | 508/391 |
| 5,011,618 | A | * | 4/1991 | Papke et al. | 508/391 |
| 5,281,345 | A | * | 1/1994 | Crawford et al. | 508/391 |
| 5,753,598 | A | * | 5/1998 | Briffett | 508/221 |

FOREIGN PATENT DOCUMENTS

| | | |
|---|---|---|
| EP | 0331359 | 6/1989 |
| EP | 0354647 | 2/1990 |
| WO | WO9746643 | 11/1997 |
| WO | WO9746645 | 11/1997 |
| WO | WO9850501 | 12/1998 |

OTHER PUBLICATIONS

U.S. patent application Ser. No. 09/041,494, Muir et al., filed Mar. 13, 1998.
PCT Search Report for corresponding PCT application dated Jun. 14, 1999.

* cited by examiner

*Primary Examiner*—Margaret Medley
(74) *Attorney, Agent, or Firm*—Michael P. Dilworth

(57) ABSTRACT

An overbased calcium sulfonate detergent having a high viscosity is characterized by forming a clear solution in lubricating oil, having a TBN of about 400 or more, and having a viscosity of at least 180 $mm^2/s$ at 100° C. The high viscosity of the detergent allows for reduction in expensive high viscosity oil components of marine cylinder oils while maintaining selected TBN and viscosity parameters in the finished oil.

32 Claims, No Drawings

HIGH VISCOSITY OVERBASED SULFONATE DETERGENT AND MARINE CYLINDER OILS CONTAINING SAME

CROSS REFERENCE TO RELATED APPLICATIONS

This is a division of US application 09/041494, filed Mar. 12, 1998, the entire disclosure of which, including the claims, is incorporated herein by reference.

BACKGROUND OF THE INVENTION

1. Field of the Invention

This invention relates to marine cylinder oils containing overbased detergents for the lubrication between piston rings and cylinder walls in high output adverse environment engines, and to overbased calcium sulfonate detergents therefor.

2. Background and Discussion of Prior Art

Particularly high rates of wear occur in high output marine engines or oceangoing vessel diesel engines, and particularly when these adverse environment engines are operated on fuels containing significant amounts of sulfur and asphaltenes. The oils subject to these adverse cylinder and piston ring environments are known as marine cylinder oils or cylinder oils. It was therefore necessary for marine cylinder oils to meet diverse stringent requirements. Marine cylinder oils are, generally speaking, blends of a high viscosity base oil and a solvent neutral or paraffinic oil, with detergents such as an overbased calcium sulfonate and overbased calcium phenate.

Marine cylinder oils are consumed with each stroke at a typical rate of about 0.9 g/hphr (1.20 g/kwhr) while being subjected to a severe environment. The marine cylinder oils, unlike conventional lubricating oils, must perform extremely broad functions, including the ability to spread over the entire cylinder liner surface, the ability to resist the effects of temperature, pressure, oxygen, moisture, and combustion products, the ability to maintain an oil film between piston rings, piston and cylinder liners, and also the ability to prevent corrosive wear and resist oxidation under extreme conditions.

In addition to the foregoing stringent demands, the marine cylinder oil art greatly desired a low cost product particularly so because of the high level of consumption.

Reported test data suggests that cylinder liner wear and piston ring wear would decrease with increase in the marine cylinder oil viscosity. The art, was for the foregoing reasons, directed to additive packages for improving viscosity as well as other characteristics. Additives, however, are costly components.

Another prior art solution to achieve the requisite viscosity was to provide substantial amounts of a high viscosity lubricating base oil having a viscosity of at least about 430 to 850 $mm^2/s$ at 40° C. (2000 to 4000 SUS at 100° F.), in combination with the low cost, low viscosity, refined solvent neutral or paraffinic oil which has a viscosity of only about 117 $mm^2/s$ (500 SUS at 100° F.). The high viscosity base oil, such as a bright stock oil, however, was more costly and less stable at high temperatures than the solvent neutral oil.

The art directed to lubricating oils required overbased detergents with improved filterability and reduced viscosity, and was therefore directed away from the use of high viscosity detergents. This prior art direction is discussed in U.S. Pat. No. 5,011,618, granted Apr. 30, 1991 to Papke et al and U.S. Pat. No. 4,387,033, granted Jun. 7, 1983 to Lenack et al.

The present invention provides improved marine cylinder oil viscosity with a reduction in the amount of the high viscosity base oil, thereby, achieving cost effectiveness.

SUMMARY OF THE INVENTION

The invention is, in one aspect, a novel overbased calcium sulfonate detergent which produces clear solutions in lubricating oil, has a TBN of at least about 400 (i.e. about 400 or more), and which has a viscosity of at least 180 $mm^2/s$ (180 cST) at 100° C. Such calcium sulfonate detergents are particularly useful in marine cylinder oil compositions. The inventive detergents are especially useful in formulating marine cylinder oil compositions which comprise a blend of expensive high viscosity lubricating oil and lower cost low viscosity oil, where their high viscosity, when used alone or in combination with another high viscosity detergent such as an overbased calcium phenate, allows a commensurately proportional reduction of the high viscosity oil, relative to compositions prepared with prior art detergents, while maintaining a selected TBN and viscosity in finished oil composition.

Marine cylinder oil compositions formulated to specified viscosity and TBN specifications and employing a blend of two oils of substantially different viscosity constitute a further aspect of the invention. In such oils the weight percent of the higher viscosity oil in the blend is inversely commensurately proportional to the viscosity of the detergent. That is, for an amount of detergent calculated to provide a given TBN in the finished oil, the higher the detergent viscosity the lesser the amount of the higher viscosity oil is required to achieve a specified finished oil viscosity.

A method of preparing the high viscosity calcium sulfonate detergent of the invention constitutes a still further aspect of the invention.

DESCRIPTION OF THE INVENTION

The Marine Cylinder Oil

The term "substantially higher" as used hereinbefore and hereinafter in the context of the difference between viscosities of two lubricating oils in a blend means that the viscosity of the higher viscosity oil is at least about 170 $mm^2/s$ at 40° C. (800 SUS at 100° F.) greater than the viscosity of the lower viscosity oil.

A cost effective way to achieve a desired finished marine cylinder oil viscosity is to blend relatively substantial amounts of an inexpensive low viscosity oil, suitably one having a viscosity of 195 $mm^2/s$ at 40° C. (900 SUS at 100° F.) or less, with an expensive high viscosity oil, such as a bright stock oil of about 430 $mm^2/s$ at 40° C. (2000 SUS at 100° F.) or more. The finished marine cylinder oils may contain a detergent component which is composed of up to 100% of the overbased calcium sulfonate of the invention. Optionally, the detergent component will contain a combination of a high viscosity overbased calcium sulfonate of the invention and a high viscosity overbased calcium phenate. Insofar as the high viscosity overbased phenate is generally more costly than the high viscosity overbased sulfonate, a blend of the phenate and sulfonate provides optimization of both viscosity and economy.

The marine cylinder oil of the present invention, in an exemplary embodiment, comprises a blend of a solvent neutral paraffinic or like oil having a relatively low viscosity of no more than about 117 $mm^2/s$ at 40° C. (500 SUS at 100° F.), a bright stock or like oil having a relatively high viscosity of at least about 430 $mm^2/s$ at 40° C. (2000 SUS at 100° F.), and a detergent component comprising a high viscosity overbased calcium sulfonate detergent of the invention, optionally in combination with a calcium phenate detergent.

The marine cylinder oil compositions suitably comprises no more than about 35% by weight, and preferably no more than about 30% by weight, of the high viscosity oil, and yet achieves a desired marine cylinder oil blend viscosity of at least about 15 to 25 $mm^2/s$ or more at 100° C. at a specified TBN of at least about 10 and preferably at least about 50 to 90 or more. The oil composition TBN is determined by the amount of the overbased calcium sulfonate and, if used, the overbased calcium phenate used in the composition.

The overbased detergent is present in the marine cylinder oil in amounts of about 2 to 25% by weight and preferably about 10 to 20% by weight. Where a combination of detergents is used, the total detergent present in the marine cylinder oil is preferably in an amount of about 10 to 25% by weight.

The low viscosity solvent neutral oil preferably has a viscosity of no more than about 195 $mm^2/s$ at 40° C. (900 SUS at 100° F.), and especially suitably has a viscosity of 500 SUS at 100° F. (117 $mm^2/s$ at 40° C.) or less. The relatively low cost, low viscosity solvent neutral oil may be present in the marine cylinder oil in amounts greater than about 40% by weight, and preferably 80% by weight or more, where the high viscosity overbased detergent is present.

It has-been found that the marine cylinder oil of the present invention achieves a comparable viscosity to that of prior art blends but can reduce the high viscosity lubricating oil (e.g. bright stock oil) component- requirement by at least 10% by weight, and generally from 12 to 16% by weight or more. This reduction can substantially lower the cost of the finished marine cylinder oil.

In the finished marine cylinder oil, other additives may be included such as dispersants, pour depressors, antioxidants, oleaginous agents, antifoamants and mixtures thereof. A preferred dispersant is an alkyl succinimide, which is added in amounts of from about 1 to 2%. A still further specific additive which may be included is a polymeric dimethyl silicone antifoamant. The silicone polymer antifoamant is desirably employed in amounts of about 100 to 1000 ppm.

The marine cylinder oil of the present invention may preferably be substantially free of costly viscosity index improvers.

The High Viscosity Overbased Calcium Sulfonate

The high viscosity overbased calcium sulfonate detergents of the invention have a viscosity of about 180 $mm^2/s$ or higher, suitably up to 800 $mm^2/s$ at 100° C., and preferably from 180 to 500 $mm^2/s$ at 100° C.

The inventive overbased calcium sulfonate is suitably formed from a mixture of a sulfonic acid, a hydrocarbon solvent, an alcohol, water and adding a stoichiometric excess of a calcium hydroxide above that required to react with the sulfonic acid, and carbonating the mixture with a carbon dioxide source at a specific temperature range of 27 to 57° C. (80° to 135° F.), which after filtration and stripping produces a 400 TBN calcium sulfonate having an high viscosity of from about 180 to 500 $mm^2/s$ or higher at 100° C.

The process for preparing the high viscosity overbased calcium sulfonate includes the steps of: providing a sulfonic acid to a reactor, adding a lime reactant (i.e. calcium hydroxide or calcium oxide) to the reactor for neutralization and overbasing, adding a lower aliphatic $C_1$ to $C_4$ alcohol and a hydrocarbon solvent, to form a process mixture in a reactor which is suitably at a temperature of up to about 27° C. (80° F.), injecting carbon dioxide into the reactor at an initial temperature of 43–54° C. (110–130° F.) until substantially all of the lime has been carbonated while maintaining the exotherm of the reaction to between 27° and 57° C. (80° and 135° F.), and preferably 43° to 52° C. (110° to 125° F.), adding a quantity of oil to the reacted mixture to form a product mixture, clarifying the product mixture by filtering solids and distilling off the volatile hydrocarbon solvents and water, so that a bright, clear, highly overbased, high viscosity calcium sulfonate is formed.

The sulfonic acid may be a natural or synthetic sulfonic acid and may include a calcium salt of the sulfonic acid. In one important aspect, the present invention provides that at least 50%, and preferably 80% or more by weight of the sulfonic acid, be a natural sulfonic acid. The sulfonic acids are prepared by treating petroleum products with sulfuric acid or $SO_3$. The compounds in the petroleum product which become sulfonated contain an oil solubilizing group. The acids thus obtained are known as petroleum sulfonates. Included within the meaning of sulfonates are the salts of sulfonic acids such as those of alkylaryl compounds. These acids are prepared by treating an alkylaryl compound with sulfuric acid or $SO_3$. At least one alkyl substituent of the aryl compound is an oil solubilizing group as discussed above. The acids thus obtained are known as alkylaryl sulfonic acids and the salts as alkylaryl sulfonates. The sulfonates wherein the alkyl is a straight-chain alkyl are the well known linear alkyl sulfonates (LAS). The acids are then converted to the metal salts thereof by neutralization with a calcium compound, particularly including calcium hydroxide.

The sulfonates in addition to having a high viscosity are highly overbased. Overbased materials are characterized by a metal content in excess of that which would be present according to the stoichiometry of the calcium and the particular organic compound said to be overbased. Thus, an oil soluble monosulfonic acid, when neutralized with a calcium compound, will produce a normal sulfonate containing one equivalent of calcium for each equivalent acid. In other words, the normal sulfonate will contain one mole of calcium for each two moles of the monosulfonic acid.

By modifying well-known carbonation procedures, the novel high viscosity overbased sulfonate detergents of the invention can be obtained. These overbased materials can contain amounts of metal many times in excess of that required to neutralize the acid. The highly overbased calcium sulfonates have TBN (ASTM D 2896) values of about 400 or more, suitably up to about 500.

The lime reactant may encompass hydrated lime in the form of calcium hydroxide. Typically, the lower aliphatic alcohol reactant may be an alcohol selected from the group consisting of alkanol of from 1 to 4 carbons, and in a preferred embodiment the lower aliphatic alcohol is methanol. The quantity of $C_1$ to $C_4$ alkanol or lower aliphatic alcohol added to the reaction mixture is in amounts such that the amount of the total promoter is less than about 15% by weight of the yield of finished product formed in the last step of the process. The $C_1$ to $C_4$ alkanol is present in the range of about 8% to 10%, and usually about less than 12%, of the finished product.

The petroleum hydrocarbon solvent particularly includes a paraffinic solvent having a boiling amount range of 70° to 166° C. (160° to 330° F.).

High Viscosity Overbased Calcium Phenate

In addition to the high viscosity overbased calcium sulfonate of the invention, a high viscosity overbased calcium phenate may also be present, in combination with the sulfonate, in the marine cylinder oil. The overbased calcium phenate has a viscosity of at least about 180 $mm^2/s$ at 100° C., preferably 200 to 800 $mm^2/s$ at 100° C. more preferably 250 to 600 $mm^2/s$ at 100° C. and most preferably 250 to 400 $mm^2/s$ at 100° C.

Methods for producing useful overbased calcium phenates are disclosed in U.S, Pat. No. 5,281,345, granted January 25, 1994, to Crawford ct al., EPO 0 354 647, published Feb. 14, 1990, and U.S. Pat. No. 4,104,180, granted August 1, 1978 to Bumop ("Burnop"). While high viscosity overbased detergents are known in the art, they are often avoided. Bumop, by way of example, includes a discussion directed to avoiding the production of such high viscosity phenates.

While the invention is principally described for high viscosity sulfonates and phenates, high viscosity carboxylates are also within the contemplation of the invention. The sulfonates, phenates and carboxylates are present in the marine oil in the form of their Group I and Group II metal salts. Group I metals useful in forming the detergent include lithium, sodium and potassium. Group II metals useful in forming the detergent agent include magnesium, calcium and barium, of which calcium is most preferred.

The present invention is further illustrated by the following examples, which are not, however, to be construed as limitations. All references to "parts" or "percentages" are references to parts or percentages by weight unless otherwise expressly indicated.

EXAMPLES 1–4

Overbased Calcium Sulfonate

A sulfonic acid is prepared from 50 to 95 wt. % of a sulfonic acid made by sulfonating a 65 to 150 $mm^2/s$ at 40° C. (310 to 700 SUS at 100° F.) petroleum oil and a 5 to 50 wt. % sulfonic acid made of synthetic alkyl benezenes carbonated in the presence of calcium hydroxide, a hydrocarbon solvent and methanol.

Example 1 (Comparative)

Table 1, below, shows the results of carbonating a 95/5 parts by weight mixture of the above mentioned natural and synthetic sulfonic acids with an initial reactor temperature of 57° C. (135° F.) and controlling the exotherm to maintain the reaction below about 63° C. (145° F.).

TABLE 1

| Charge | wt % |
|---|---|
| Mixed sulfonic acid | 18.7 |
| Oil | 45.5 |
| Crude heptane | 65.2 |
| Methanol | 10.0 |
| Lime | 45.0 |
| Carbon dioxide | 16.0 |
| Carbonation temperature | 57–63° C. (135–145° F.) |
| Carbonation time | 90 minutes. |
| Results after filtration and stripping | |
| TBN | 393 |
| Calcium sulfonate, wt % | 18.5 |
| Kinetic viscosity at 100° C., $mm^2/s$ | 75 |

Example 2 (Invention)

Table 2, below, shows the results of carbonating a 95/5 parts by weight mixture of the above mentioned natural and synthetic sulfonic acid with an initial reactor temperature of 54° C. (130° F.) and controlling the exotherm to maintain the reaction below 57° C. (135° F.).

TABLE 2

| Charge | wt % |
|---|---|
| Mixed sulfonic acid | 18.7 |
| Oil | 45.5 |
| Crude heptane | 65.2 |
| Methanol | 10.0 |
| Lime | 45.0 |
| Carbon dioxide | 16.0 |

TABLE 2-continued

| Charge | wt % |
|---|---|
| Carbonation temperature | 54–57° C. (130–135° F.) |
| Carbonation time | 90 minutes |
| Results after filtration and stripping | |
| TBN | 399 |
| Calcium sulfonate, wt % | 18.8 |
| Kinetic viscosity at 100° C., $mm^2/s$ | 224 |

Example 3 (Comparative)

Table 3, below, shows the results of carbonating a 50/50 parts by weight mixture of the above mentioned natural and synthetic sulfonic acid with an initial temperature of 57° C. (135° F.) and controlling the exotherm to maintain the reaction below 63° C. (145° F.).

TABLE 3

| Charge | wt % |
|---|---|
| Mixed sulfonic acid | 17.7 |
| Synthetic sulfonate | 1.0 |
| Oil | 45.5 |
| Crude heptane | 65.2 |
| Methanol | 10.0 |
| Lime | 45.0 |
| Carbon dioxide | 16.0 |
| Carbonation temperature | 135–145° F. |
| Carbonating time | 90 minutes. |
| Results after filtration and Stripping | |
| TBN | 409 |
| Calcium sulfonate, wt % | 19.2 |
| Kinetic viscosity @ 100° C., $mm^2/s$ | 65.5 |

Example 4 (Invention)

Table 4, below, shows the results of carbonating a 50/50 parts by weight mixture of the above mentioned natural and synthetic sulfonic acid with an initial reactor temperature of 43° C. (110° F.) and controlled the exotherm to maintain the reaction below 46° C. (115° F.).

TABLE 4

| Charge | wt. % |
|---|---|
| Mixed sulfonic acid | 17.7 |
| Synthetic sulfonate | 1.0 |
| Oil | 45.5 |
| Crude heptane | 65.2 |
| Methanol | 10.0 |
| Lime | 45.0 |
| Carbon dioxide | 16.0 |
| Carbonation temperature | 43–46° C. (110–115° F.) |
| Carbonating time | 90 minutes |
| Results after filtration and stripping | |
| TBN | 400.1 |
| Calcium sulfonate, wt % | 18.0 |
| Kinetic viscosity at 100° C., $mm^2/s$ | 275 |

Examples 1–4 demonstrate that by closely controlling the reactor temperature during carbonation at temperatures between 43° to 57° C. (110° to 135° F.) and preferably between about 43° to 52° C. (110° to 125° F.), a 400 TBN overbased calcium sulfonate with an high viscosity is produced. It was found that the use of this high viscosity overbased sulfonate yields a lower cost marine cylinder oil, as demonstrated in the following Example 5.

Example 5

Marine Oil Blends

Overbased calcium sulfonate products of 405 TBN were prepared by changing process temperature conditions to obtain an 80 $mm^2/s$ at 100° C. product and a 260 $mm^2/s$ at 100° C. product of the present invention. These overbased calcium sulfonates were evaluated in typical marine cylinder oil blends. The blends were made to 70 TBN. The final viscosity of the blends was 19.5 $mm^2/s$ at 100° C. This was achieved by using combinations of a 117 $mm^2/s$ at 40° C. (500 SUS at 100° F.) viscosity solvent neutral oil and a 640 mm/s at 40° C. (3000 SUS at 100° F.) viscosity bright stock oil. The results of such blends are summarized in Table 5.

TABLE 5

| Composition | Weight % Invention | Weight % Comparative |
|---|---|---|
| Solvent neutral oil, 117 $mm^2/s$ at 40° C. | 44.6 | 40.0 |
| Bright stock oil, 640 $mm^2/s$ at 40° C. | 32.9 | 37.5 |
| 405 TBN calcium sulfonate, 260 $mm^2/s$ at 100° C. | 8.7 | — |
| 405 TBN calcium sulfonate, 80 $mm^2/s$ at 100° C. | — | 8.7 |
| 255 TBN Oloa219* (phenate), 400 $mm^2/s$ at 100° C. | 13.8 | 13.8 |
| Results | | |
| TBN | 70 | 70 |
| Viscosity ($mm^2/s$ at 100° C.) | 19.5 | 19.5 |

This comparison of marine oil blends illustrates that by using a high viscosity overbased calcium sulfonate instead of a low viscosity overbased calcium sulfonate there is a reduction of the bright stock oil by 12.1% by weight with the viscosity of the marine cylinder oil blend maintained at 19.5 $mm^2/s$ at 100° C.

Example 6

Marine Cylinder Oil Blends

400 TBN calcium sulfonates and calcium phenates of different viscosities were blended into marine cylinder oil blends to 70 TBN and 19.5 $mm^2/s$ at 100° C. viscosity. The impact of the viscosity of the overbased phenate is shown in Table 6.

TABLE 6

| Composition | Weight % Comparative | Weight % Invention |
|---|---|---|
| Solvent neutral oil, 117 $mm^2/s$ at 40° C. | 41.4 | 43.5 |
| High viscosity oil, 700 $mm^2/s$ at 40° C. | 41.3 | 39.2 |
| 400 TBN calcium sulfonate, 76 $mm^2/s$ at 100° C. | 8.7 | 8.7 |
| 400 TBN calcium phenate, 164 $mm^2/s$ at 100° C. | 8.6 | |
| 400 TBN calcium sulfonate, 314 $mm^2/s$ at 100° C. | | 8.6 |
| 400 TBN calcium phenate, 495 $mm^2/s$ at 100° C. | | |

TABLE 6-continued

| Composition | Weight % Comparative | Weight % Invention |
|---|---|---|
| Results | | |
| TBN | 69.5 | 69.8 |
| Viscosity ($mm^2/s$ at 100° C.) | 19.4 | 19.5 |

As illustrated in Examples 5 and 6, the present invention allows preparation of a marine cylinder oil at a specified viscosity of 15 to 25 $mm^2/s$ at 100° C. and a specified TBN, with a resulting reduction of more than about 12% by weight of the costly high viscosity or bright stock oil.

Whereas the prior art was compelled to include high amounts of costly high viscosity oil in marine oils, this need is substantially reduced by the high viscosity overbased detergents of the present invention.

What is claimed is:

1. An overbased calcium sulfonate detergent, the detergent forming a clear solution in lubricating oil, having a TBN of about 400 or more, and having a viscosity of at least 180 $mm^2/s$ at 100° C.

2. The overbased calcium sulfonate detergent of claim 1 wherein at least 50% by weight of the sulfonate is petroleum sulfonate.

3. The overbased calcium sulfonate detergent of claim 1 wherein at least 80% by weight of the sulfonate is petroleum sulfonate.

4. The overbased calcium sulfonate detergent of claim 1 wherein the detergent has a viscosity of 180 $mm^2/s$ to 800 $mm^2/s$ at 100° C.

5. The overbased calcium sulfonate of claim 1 wherein the detergent has a viscosity of 180 to 500 $mm^2/s$ at 100° C.

6. The overbased calcium sulfonate of claim 5 wherein the sulfonate is a mixture of petroleum sulfonate and alkylaryl sulfonate, the sulfonate mixture comprising at least 50% by weight of said petroleum sulfonate.

7. The overbased sulfonate of claim 6 wherein the sulfonate mixture comprises 50 to 95% by weight of petroleum sulfonate and 5 to 50% by weight of alkyl benzene sulfonate.

8. A process for preparing a high viscosity overbased calcium sulfonate comprising the steps of:

providing a sulfonic acid to a reactor, adding a lime reactant to the reactor for neutralization and overbasing;

adding a lower aliphatic $C_1$ to $C_4$ alcohol and a hydrocarbon solvent, to form a process mixture in the reactor, carbonating the process mixture by injecting carbon dioxide into the reactor, adding an oil to the process mixture to form a product mixture, clarifying the product mixture by removing any solids, removing water and any remaining hydrocarbons from the product mixture after clarification, and isolating an overbased calcium sulfonate having a TBN of at least 400, wherein, during carbonation the exotherm of the reaction is maintained at a temperature between 27° and 57° C.

9. The process as in claim 8 wherein an initial reactor temperature prior to carbonation is from 43° to 54° C.

10. The process of claim 9 wherein during carbonation, the exotherm of the reaction is maintained at a temperature between 43° and 52° C.

11. A marine cylinder oil composition comprising a mixture of at least two oils, a first of said two oils having a viscosity at least 170 $mm^2/s$ at 40° C. higher than a second oil, and an overbased detergent component, the composition having a TBN of 50–90 and being substantially free of viscosity index improvers, and the detergent component comprising an overbased calcium sulfonate having a viscosity of at least 180 $mm^2/s$ at 100° C. and a TBN of about 400 or more.

12. A marine cylinder oil composition as in claim 11 wherein the overbased detergent component further comprises a calcium phenate having a viscosity of at least 200 $mm^2/s$ at 100° C.

13. A marine cylinder oil composition as in claim 12 wherein the calcium phenate has a viscosity of at least 250 $mm^2/s$ at 100° C.

14. A marine cylinder oil composition as in claim 13 wherein the calcium phenate has a TBN of about 400.

15. The marine cylinder oil composition as in claim 11 wherein the composition has a viscosity of 15 to 25 $mm^2/s$ at 100° C. and a TBN of at least 10.

16. A marine cylinder oil composition as in claim 11 wherein the overbased detergent component is present in an amount of 2–25% by weight of the composition.

17. A marine cylinder oil composition as in claim 16 wherein the detergent component consists of said overbased calcium sulfonate, and is present in an amount of 10 to 20% by weight of the composition.

18. The marine cylinder oil composition as in claim 16 wherein the detergent component is present in an amount of 10 to 25% by weight of the composition and comprises the overbased calcium sulfonate and an overbased calcium phenate having a viscosity of at least 250 $mm^2/s$ at 100° C.

19. The marine cylinder oil composition as in claim 11 wherein one of said at least two oils comprises a solvent neutral oil having a viscosity of no more than about 195 $mm^2/s$ at 40° C. present in an amount of at least 40% by weight of the composition.

20. A marine cylinder oil composition as in claim 19 wherein said solvent neutral oil is present in an amount of at least 80% by weight of the composition.

21. A marine cylinder oil as in claim 11 wherein the overbased calcium sulfonate is a product prepared by overbasing a sulfonic acid, at least 50% of the sulfonic acid being natural sulfonic acid.

22. A marine cylinder oil as in claim 21 wherein at least 80% of said sulfonic acid is natural sulfonic acid.

23. A marine cylinder oil as in claim 21 wherein the composition has a viscosity of 15 to 25 $mm^2/s$ at 100° C.

24. A marine cylinder oil comprising a low viscosity oil present in an amount of about 40 to about 45 wt. % based on a total amount of said marine cylinder oil;

a high viscosity oil, said high viscosity oil having a viscosity at least 170 $mm^2/s$ at 40° C. greater than said low viscosity oil present in an amount of about 32 to about 39 wt. % based on a total amount of said marine cylinder oil; and a high viscosity overbased calcium sulfonate detergent having a viscosity of about 260 $mm^2/s$ at 100° C. present in an amount of about 8 to about 9 wt. % based on a total amount of said marine cylinder oil, said high viscosity overbased sulfonate detergent having a TBN of more than 400, wherein a total base number of said marine cylinder oil is about 50 to about 90 and said marine cylinder oil is substantially free of viscosity index improvers.

25. The marine cylinder oil of claim 24 further including an overbased calcium phenate detergent present in an amount wherein a total amount of all overbased detergents is about 10 to about 25 wt. % based on a total amount of said marine cylinder oil.

26. The marine cylinder oil of claim 25 wherein said overbased calcium phenate detergent has a viscosity of about 164 to about 400 $mm^2/s$ at 100° C.

27. The marine cylinder oil of claim 24 wherein said high viscosity overbased calcium sulfonate detergents has a total base number of about 400 to about 405.

28. The marine cylinder oil of claim 24 wherein said high viscosity overbased calcium sulfonate detergents is formed by providing a sulfonic acid wherein at least 80 wt. % of said sulfonic acid comprises a natural sulfonic acid;

neutralizing and overbasing said sulfonic acid with an excess of a lime reactant comprising calcium hydroxide or calcium oxide;

adding a lower aliphatic alcohol having 1 to 4 carbon atoms and a hydrocarbon solvent;

carbonating the mixture with carbon dioxide at an initial temperature of about 43 to about 54° C. while maintaining the exotherm of the reaction below 57° C.;

adding a quantity of oil to form a product mixture;

clarifying the product mixture; and isolating a clear, highly overbased, high viscosity calcium sulfonate after clarification.

29. The marine cylinder oil of claim 24 further including additives selected from the group consisting of dispersants, pour depressors, antioxidants, oleaginous agents, antifoamants, and mixtures thereof.

30. The marine cylinder oil of claim 29 wherein said additives comprise a dispersant comprising alkyl succinimide present in an amount of about 1 to about 2 wt. % and an antifoamant comprising polymeric dimethyl silicone present in an amount of about 100 to about 1000 ppm based on a total amount of said marine cylinder oil.

31. The marine cylinder oil of claim 25 wherein the overbased calcium phenate detergent is present in an amount of about 8 to about 14 wt. % based on a total amount of said marine cylinder oil.

32. A marine cylinder oil comprising a low viscosity oil present in an amount of about 40 to about 45 wt. % based on a total amount of said marine cylinder oil;

a high viscosity oil, said high viscosity oil having a viscosity at least 170 $mm^2/s$ at 40° C. greater than said low viscosity oil present in an amount of about 32 to about 39 wt. % based on a total amount of said marine cylinder oil;

a high viscosity overbased calcium sulfonate detergent having a viscosity of about 314 $mm^2/s$ at 100° C. present in an amount of about 8 to about 9 wt. % based on a total amount of said marine cylinder oil, said high viscosity overbased sulfonate detergent having a TBN of more than 400, wherein a total base number of said marine cylinder oil is about 50 to about 90 and said marine cylinder oil is substantially free of viscosity index improvers.

* * * * *